US006840914B1

(12) United States Patent
Takamura

(10) Patent No.: US 6,840,914 B1
(45) Date of Patent: Jan. 11, 2005

(54) ELECTRICALLY POWERED ROLLER MASSAGING IMPLEMENT

(76) Inventor: Shigeo Takamura, 2-25-13 Umezato Suginami-ku, Tokyo 166-0011 (JP)

( * ) Notice: Subject to any disclaimer, the term of this patent is extended or adjusted under 35 U.S.C. 154(b) by 0 days.

(21) Appl. No.: 10/031,973

(22) PCT Filed: Oct. 1, 1999

(86) PCT No.: PCT/JP99/05410

§ 371 (c)(1),
(2), (4) Date: May 2, 2002

(87) PCT Pub. No.: WO01/08627

PCT Pub. Date: Feb. 8, 2001

(30) Foreign Application Priority Data

Jul. 29, 1999 (JP) ..... 11/215365

(51) Int. Cl.[7] ..... A61H 15/00

(52) U.S. Cl. ..... 601/99; 601/98; 601/102; 601/116

(58) Field of Search ..... 601/49, 56, 84, 601/90–95, 97, 98, 99, 100, 101, 102, 103, 115, 116, 126, 128

(56) References Cited

U.S. PATENT DOCUMENTS

| | | | | | |
|---|---|---|---|---|---|
| 3,675,644 | A | * | 7/1972 | Laskowitz | 601/115 |
| 4,748,972 | A | * | 6/1988 | Hasegawa | 601/49 |
| 5,429,585 | A | * | 7/1995 | Liang | 601/49 |
| 5,462,515 | A | * | 10/1995 | Tseng | 601/49 |
| 6,039,705 | A | * | 3/2000 | Wu | 601/99 |
| 6,196,983 | B1 | * | 3/2001 | Wu | 601/99 |
| 6,200,282 | B1 | * | 3/2001 | Furuie et al. | 601/98 |
| 6,224,563 | B1 | * | 5/2001 | Nonoue et al. | 601/99 |

FOREIGN PATENT DOCUMENTS

| | | | | |
|---|---|---|---|---|
| DE | 298 14 918 U1 | | 11/1998 | |
| EP | 0 361 302 A2 | | 4/1990 | |
| JP | 49-34584 | | 3/1974 | |
| JP | 55-163047 | | 12/1980 | A61H/15/00 |
| JP | 61-177631 | | 11/1986 | A61H/7/00 |
| JP | 405300925 A | * | 11/1993 | A61H/7/00 |
| JP | 406165802 A | * | 6/1994 | A61H/15/00 |
| JP | 7-80035 | | 3/1995 | A61H/7/00 |
| TW | 30210 | | 5/1980 | |
| TW | 282666 | | 8/1996 | |

* cited by examiner

*Primary Examiner*—Nicholas D. Lucchesi
*Assistant Examiner*—Quang D Thanh
(74) *Attorney, Agent, or Firm*—Pearne & Gordon LLP

(57) ABSTRACT

A roller drive device has a frame composed of a base portion and left and right edge portions standing upright from the left and right edges of the base portion, and a longitudinal guide slit provided in each of the left and right edge portions. A shaft having a gear is mounted to each of the upper and lower ends of the frame, and a roller chain is mounted in a ring shape around the upper and lower shafts meshing with the gears. A shaft bushing fixed to massaging ball rollers is mounted to the roller chain, and the left and right ends of the shaft bushings are mounted in an inserted state in the guide slits. There is also provided a motor-driven roller message instrument mounted with such a roller drive drive.

18 Claims, 11 Drawing Sheets

ELECTRICALLY POWERED ROLLER MASSAGING IMPLEMENT

TECHNICAL FIELD

This invention relates to a unit-type roller drive device for motor-driven roller massage actions based on the actuation of guide slit-type roller chains for use in massaging the user back through the action of pressing against one's waist, back and scruff of the neck, and also to a motor-driven roller massage instrument mounted with such a unit-type roller drive device.

BACKGROUND ART

In the prior art, there is a motor-driven roller massage instrument of a mat type having a size as long as the whole human body. A power transmission device portion of the above motor-driven roller massage instrument has left and right roller travel guide rails respectively incorporating stainless steel belts of a size as long as the whole human body. A single drive source motor is installed on one end side of the guide rails, and a roller is mounted to the motor to mount a motor-driven roller travel belt to the roller axially. Then, a receiving box for taken-up belt and a single drive source motor are required for a set of a starting mechanism and a terminating mechanism of the roller travel belt. Therefore, a double belt structure for forward and backward traveling is applied to the roller travel belt, which needs traveling from the starting mechanism to the terminating mechanism via a turn-back mechanism (due to the use of the single motor). For that reason, a structure of a so-called double structure power transmission device of the roller travel belt has been in use. That is, the repetitive forward and backward traveling is required for the roller travel belt, whenever this roller travel belt is received in an empty box for taken-up belt after traveling from the terminating mechanism to the starting mechanism via the turn-back mechanism in succession to the above traveling.

On the other hand, there is a device having a roller massage device incorporated only in the back portion. This device is of a type, in which a longitudinally spiral shaft is mounted to the back portion, and a massaging ball roller portion is mounted pivotally to the spiral shaft to rotate massaging ball rollers vertically in cooperation with the rotation of the spiral shaft.

However, the above motor-driven roller massage instrument in the prior art requires the stainless steel belt to ensure a certain degree of strength and elasticity, since it is necessary to mount the roller travel belt of a size as long as the whole human body. The accurate installation of guide rails or the like is also required to prevent the stainless steel belt from being twisted or crossed and so on in the course of traveling, together with a large number of auxiliary portions other than the guide rails. The receiving box for taken-up belt is further required due to the application of a belt take-up mode. For that reason, there is a need for complicated, large-volume, heavyweight mechanism, resulting in an increase of manufacture cost.

Further, a product in the prior art incorporating the drive device of a roller massage instrument into the back of a chair needs to have a thick seat portion and so on, since a large-sized motor is installed in the seat portion. For that reason, the above product results in an increase in size and weight as a whole, and thus finds difficulty in movement.

In view of the above circumstances, a mechanically-simple, trouble-free, low-cost, versatile motor-driven roller massage instrument (See Japanese Patent Application Nos. 10-193605 and 10-193609) was developed by the present applicants for application to keep the ideal figure with a stretch of the line of the backbone naturally.

An object of the present invention is to provide a more simple compact roller drive device for more certain smooth driving of a motor-driven roller massage instrument than the previously applied invention, and also to provide a motor-driven roller massage instrument mounted with such a roller drive device.

[Disclosure of the Invention]

There is provided a roller drive device of a size as approximately high as the back of the human body. The roller drive device has a frame composed of a base portion and left and right edge portions standing upright from the left and right edges of the base portion, and a longitudinal guide slit is provided in each of the left and right edge portions of the frame. A shaft having a gear is mounted to each of the upper and lower ends of the frame, and a roller chain is mounted in a ring shape round the upper and lower shafts in meshing with the gears. A shaft bushing fixed to massaging ball rollers is mounted to each roller chain, and the left and right ends of the shaft bushings are mounted in the guide slits in an inserted state. With the above structure, the roller chains are moved vertically by rotation of the shafts with a drive motor, and in cooperation with the vertical movement of the roller chains, the massaging ball rollers are guided in accordance with the guide slits for vertical movement. There are also provided a motor-driven roller massage instrument and a legless chair respectively mounted with such a roller drive device.

BEST MODE FOR CARRYING OUT THE INVENTION

Figure 1:
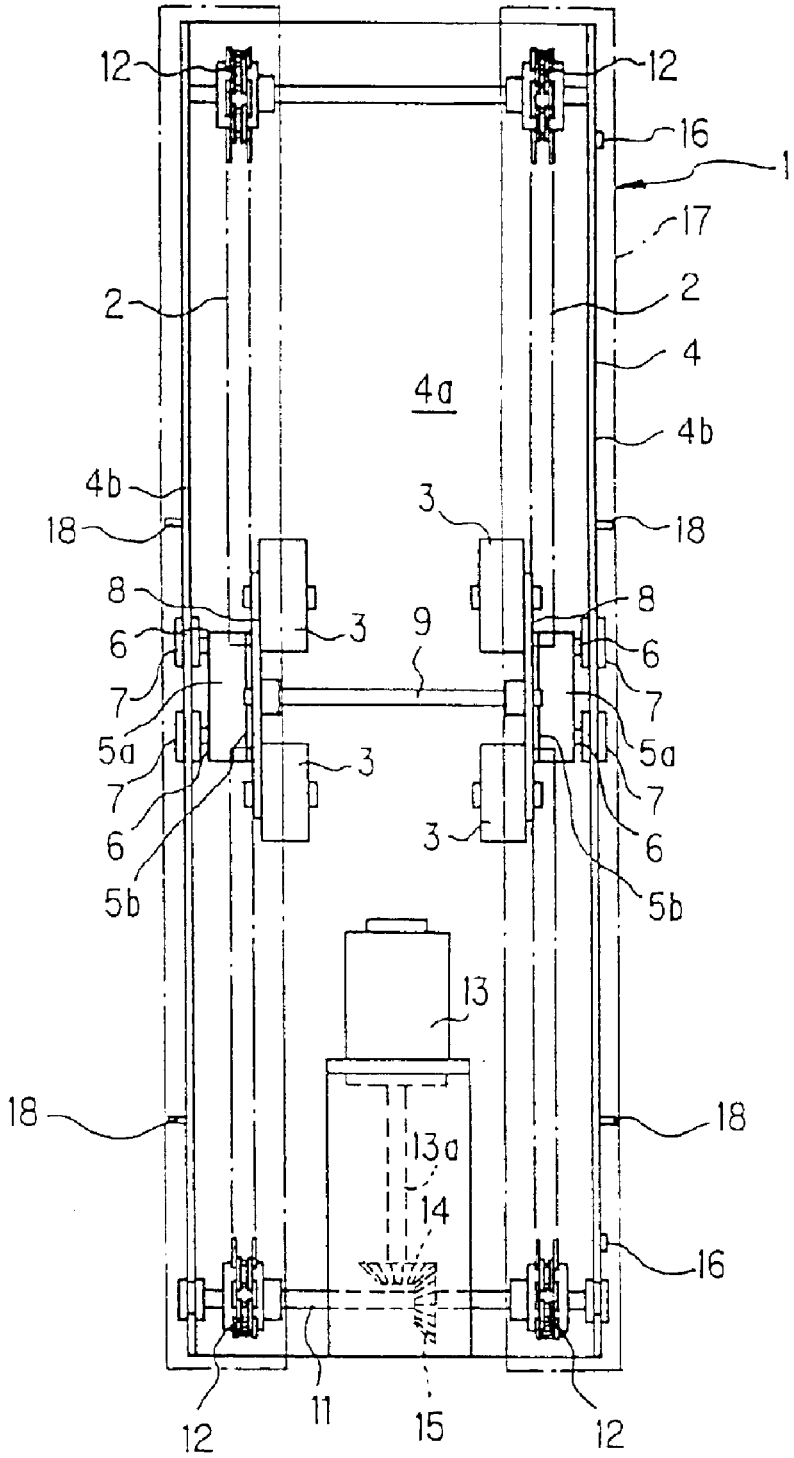
FIG. 1 is a front view showing a roller massage device according to the present invention.

Hereinafter will be described the present invention on the basis of illustrated embodiments. Reference numeral 1 denotes a roller drive device according to the present invention. The roller drive device 1 has a size as approximately high as the back of the human body and is structured to move massaging ball rollers 3 mounted to roller chains 2 vertically in cooperation with the vertical movement of the roller chains 2.

Figure 2:
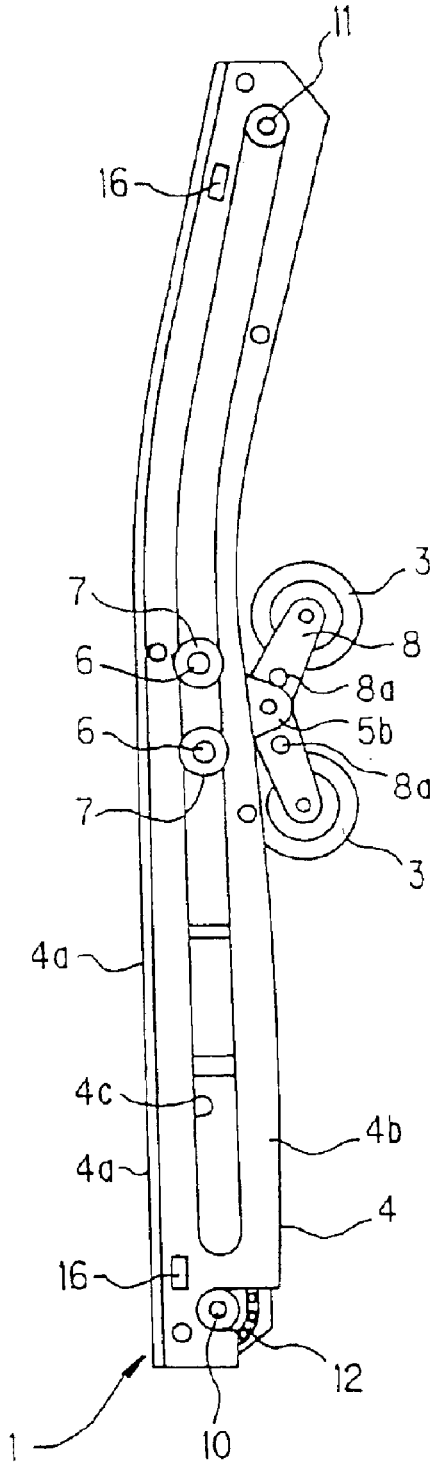
FIG. 2 is a left side view showing the same; showing the same.
Figure 3:
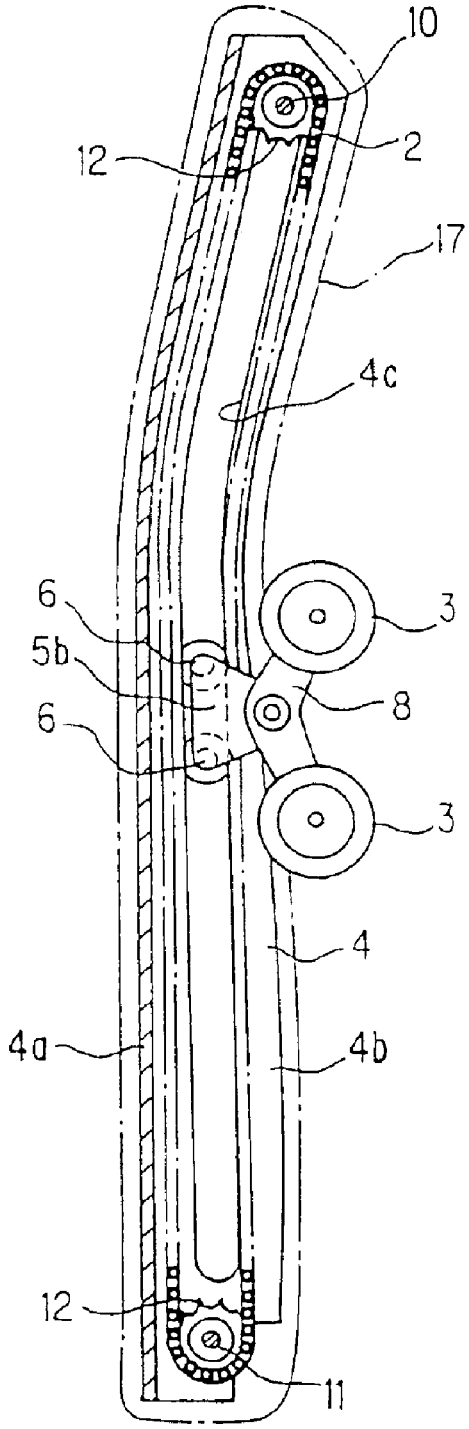
FIG. 3 is a vertical section view with parts broken away.
Figure 4:
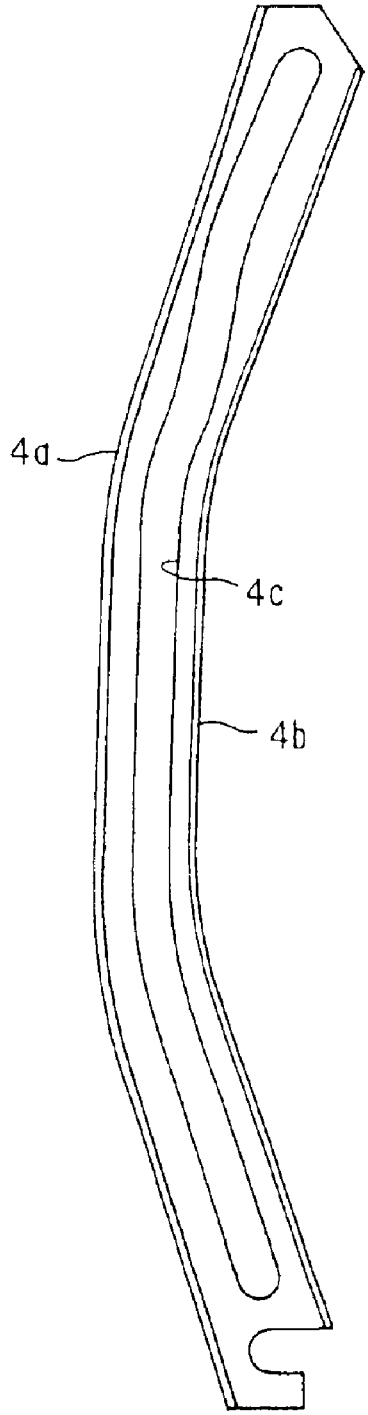
FIG. 4 is a left side view showing another embodiment of a guide slit.
Figure 5:
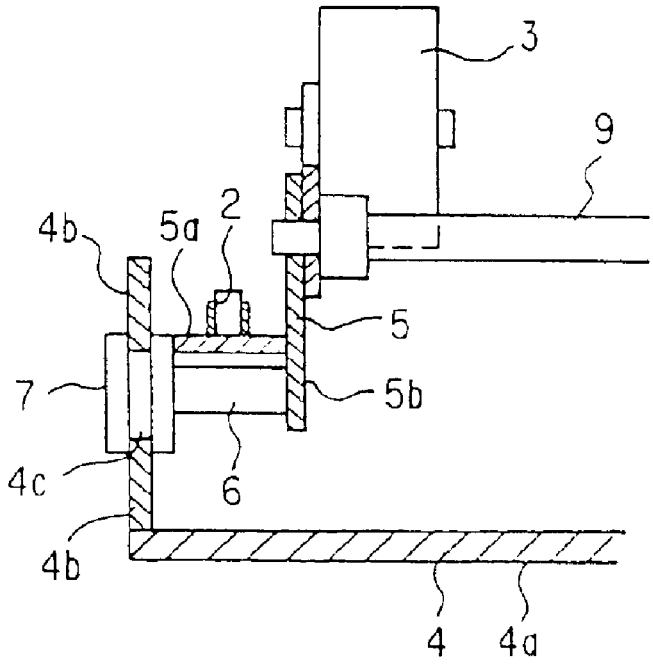
FIG. 5 is a fragmentary sectional side view showing the massaging roller mount portion.
Figure 6:
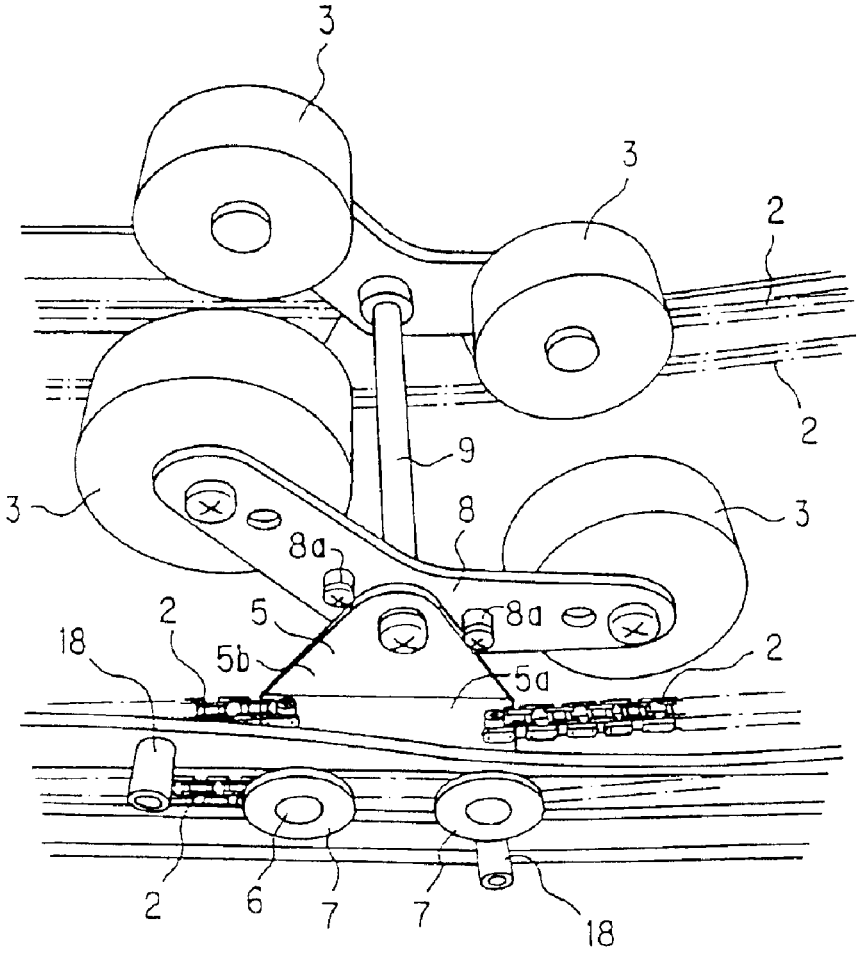
FIG. 6 is a fragmentary perspective view showing a massaging roller mount portion.

A description of the roller drive device 1 will be given in more details. Reference numeral 4 denotes a frame, which houses the whole roller drive device 1. The frame 4 is formed in a channel-like plate shape by a lengthwise rectangular plate-shaped base portion 4*a* and left and right edge portions 4*b*, 4*b* standing upright from the left and right edges of the base portion along the longitudinal direction thereof. The left and right edge portions 4*b*, 4*b* are respectively provided with longitudinal (vertical) guide slits 4*c*. As shown in FIG. 2, each guide slit 5*c* is curved gently (as seen from the front) so as to make a dent in its intermediate portion, and is therefore adapted to a back curve natural for aged users as well. Incidentally, it is to be understood that each guide slit 4*c* might be curved in a desired shape as one like the letter S, which makes it possible to keep the ideal figure, as shown in FIG. 4, for instance, without being limited to the above embodiment.

The massaging ball rollers 3 are guided in accordance with each guide slit 4*c* through a shaft bushing 5 for vertical movement. Each shaft bushing 5 has a rectangular plate-shaped base portion 5*a* and a triangular rising piece 5*b* extending from the inner edge of the surface of the base portion 5*a*, and two pieces of pins 6 are projecting from the back of the base portion 5*a* outwardly. Then, a rotatable guide roller 7 is mounted to the end of each of the two pieces of pins 6. The guide rollers 7 are mounted in an inserted state in each guide slit 4*c*, and the massaging ball rollers 3 are mounted in a rotatable state to the top end of each rising piece 5*b* through a massaging ball roller mount piece 8.

The massaging ball roller mount piece 8 is formed in a shape like the letter V and is mounted in a pivotal state to each rising piece 5*b*. The massaging ball roller mount piece 8 has a stopper 8*a* projecting outwardly from each of side pieces inclined in two directions, and contact of each stopper 8*a* with the rising piece 5*b* makes it possible to prevent the excessive downward movement of the massaging ball rollers. Then, the massaging ball rollers 3 are mounted respectively to the left and right top ends of each massaging ball roller mount piece 8 for appropriately longitudinal movement. There are two massaging ball rollers 3 along the inside of each of the left and right edge portions 4*b*, 4*b* of the frame 4. The left and right massaging ball rollers 3, 3 are connected together through a shaft 9 mounted across the massaging ball roller mount pieces 8, 8. Incidentally, it is to be understood that the massaging ball roller mount pieces 8 might be modified (not shown) and so on for installation of one or a plurality of massaging ball rollers 3 other than two, without being limited to two massaging ball rollers on each side.

The opposite ends of each roller chain 2 mounted in a ring-shape are fixed in a ring shape to the base portion 5*a* of each shaft bushing 5. Each roller chain 2 is mounted tensely in a ring shape round gears 12, 12 (corresponding to pulleys) mounted to shafts 10, 11 respectively mounted across the upper ends and the lower ends of the side edge portions 4*b* of the frame 4. Then, a drive motor 13 is mounted to the center of the lower end of the base portion 4*a* of the frame 4. The motor 13 provides slowing-down rotation to the shaft 11 through a bevel gear 14 mounted to a shaft 13*a* projecting downward from the drive motor 13 and a bevel gear 15 mounted to the shaft 11. With the rotation of the shaft 11, the gears 12 mounted to the left and right ends of the shaft 11 are rotated to move the roller chains 2 and the massaging ball rollers 3 vertically. Sensors 16 to vary the turning direction of the motor 13 are mounted to one side edge portion 4*b* in the vicinity of the upper and lower shafts 10, 11 of the side edge portions 4*b* of the frame 4, permitting the repetitive forward and backward movement of the massaging ball rollers 3. Projections 18 respectively having machine screw holes are also provided in the side edge portions 4*b* for mounting a cover 17 for protection of the roller chains 2.

The above roller drive device 1 according to the present invention is used as a unit incorporated constantly into the back of an appliance such as the seats of chairs, trains, planes and automobiles, for instance, or alternatively, may be applied as an independently available motor-driven roller massage instrument.

Figure 7:
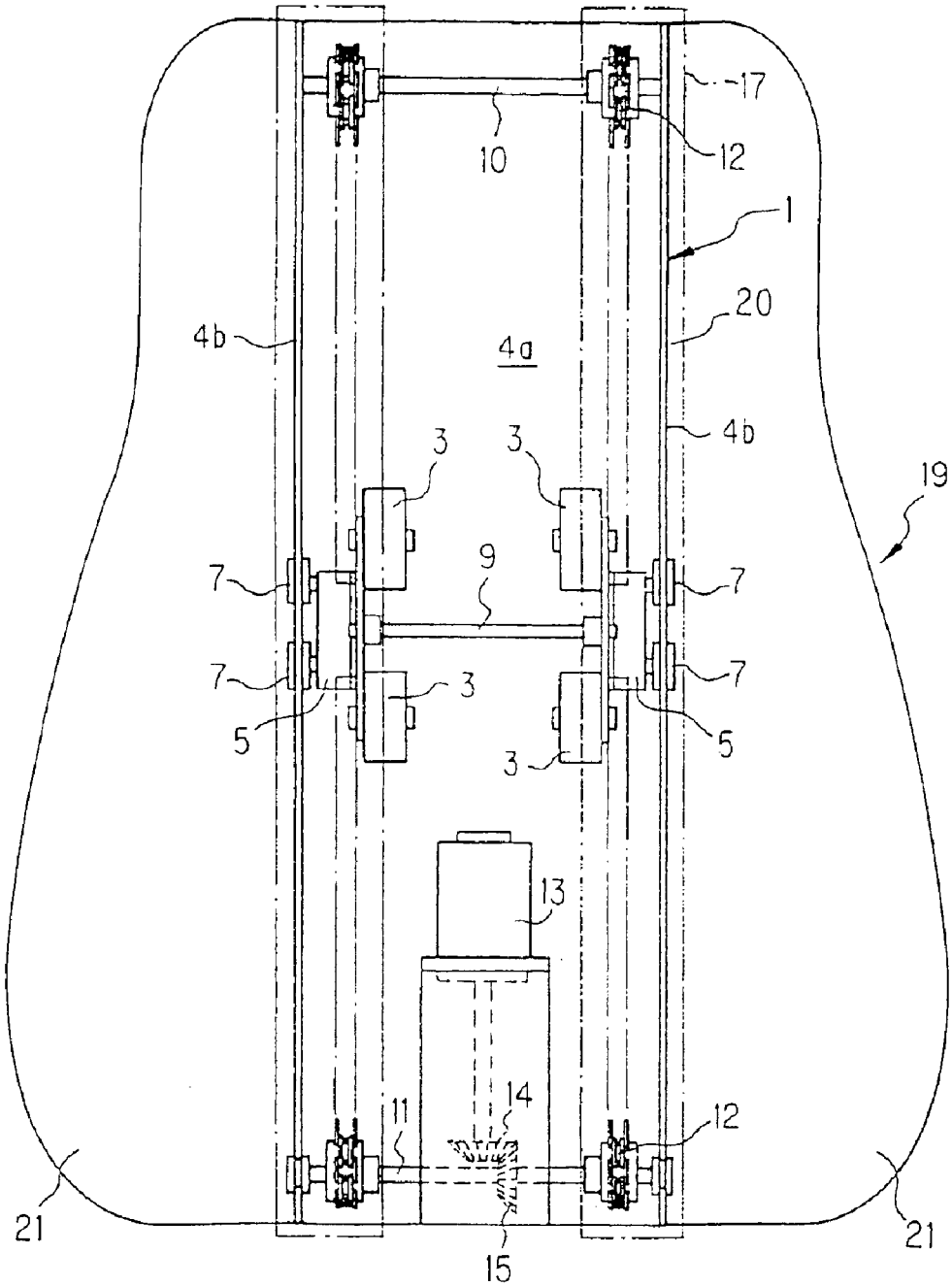
FIG. 7 is a front view showing a motor-driven roller massage instrument according to the present invention.
Figure 8:
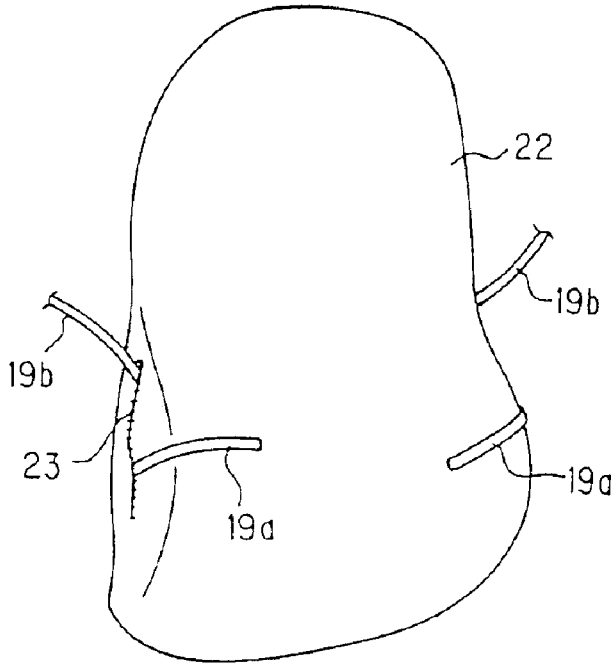
FIG. 8 is a front perspective view showing the motor-driven roller massage instrument.
Figure 9:
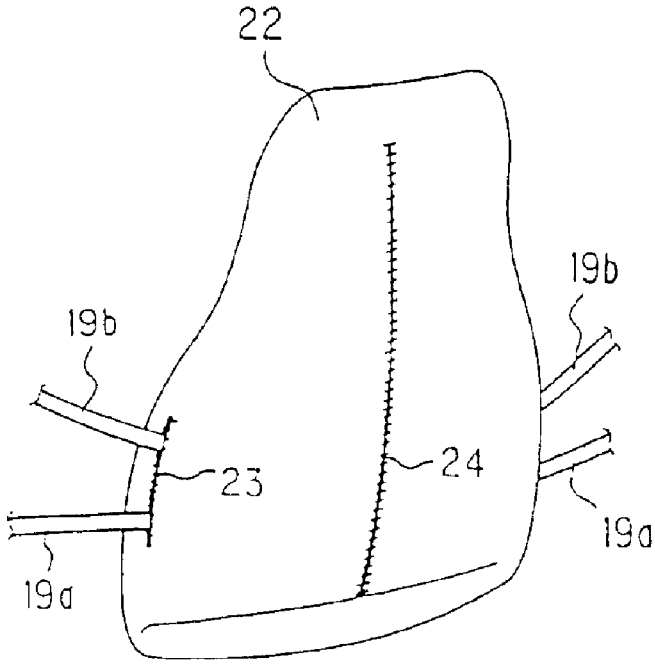
FIG. 9 is a back perspective view showing the motor-driven roller massage instrument.

FIGS. 7 to 9 show one embodiment of the motor-driven roller massage instrument incorporating the above roller drive device 1. Reference numeral 19 denotes a back base body, and the back base body 19 is formed of hard synthetic resin in a forwardly curved bucket-like shape of a size as approximately high as the back of the human body. The back base body has a widthwise central concave portion 20 extending from the upper end to the lower end of the back base body for installation of the roller drive device. The back base body also has outwardly-expanded left and right blade piece portions 21, 21 on the left and right sides of the back base body in the range of their intermediate portions to their lower ends. These left and right blade piece portions 21, 21 are thinner than the other portion to offer flexibility. Further, the roller drive device 1 is incorporated into the concave portion 20 for installation of the roller drive device.

The left and right blade piece portions 21, 21 of the back base body 19 have belts 19*a* for fastening the human body to the back base body 19 and belts 19*b* for fastening the back base body 19 to the seat of chair or automobile or like appliance.

In FIGS. 8 and 9, a reference numeral 22 denotes a surface cover for covering the whole back base body 19 incorporating the roller drive device 1. The surface cover 22 has left and right insertion slits for allowing the fastening belts 19*a*, 19*b* to pull out to the outside, and a fastener 23 is mounted to each of the left and right insertion slits. A longitudinal fastener 24 is also provided in the widthwise center of the surface cover for allowing the easy detachment of the cover.

In use, the motor-driven roller massage instrument incorporating the roller drive device 1 according to the present invention as described above is fastened to the other appliance with the fastening belts 19*b* (or allows to remain as it is when the other appliance is not in use). Then, the left and right blade piece portions 19, 19 are further curved to be fit to the user body, and in this state, the user body is fastened with the fastening belts. Thereafter, turning the switch of the drive motor ON allows the roller drive device 1 to drive for gradually vertical movement of the roller chains 2. In cooperation with the vertical movement of the roller chains, the massaging ball rollers 3 make roller massaging actions by pressing against the user back ranging from the scruff of the neck to the waist in sequence according to a guided curve along the guide slits 4*c*. Incidentally, the same may be said of the operation of the roller drive device 1 when incorporated as the unit into the other appliance.

Figure 10:
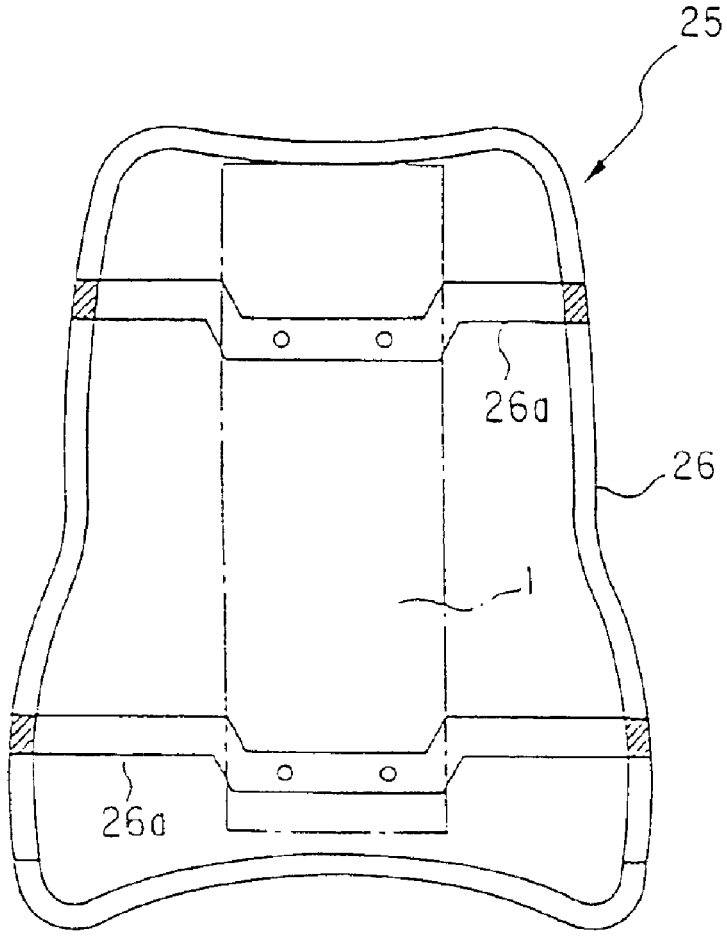
FIG. 10 is a perspective view showing a frame of a motor-driven roller massage instrument according to another embodiment.

FIG. 10 shows a frame of a motor-driven roller massage instrument 25 according to another embodiment. The motor-driven roller massage instrument 25 has an outside frame 26 formed by bending a steel pipe into a shape approximately similar to the outside shape of the above back base body 19 so as to surround the motor-driven roller massage instrument on all sides. Further, upper and lower lateral rods 26*a*, 26*a* made of band steel for supporting the upper and lower sides of a drive device are mounted across the left and right sides of the outside frame 26. The center of each of the upper and lower lateral rods 26*a*, 26*a* has a trapezoidal concave portion of a size as approximately wide as the roller drive device 1. Thus, the roller drive device 1 is mounted to the concave portions and is covered with the surface cover through a cushioning material such as a polyurethane foam material.

Figure 11:
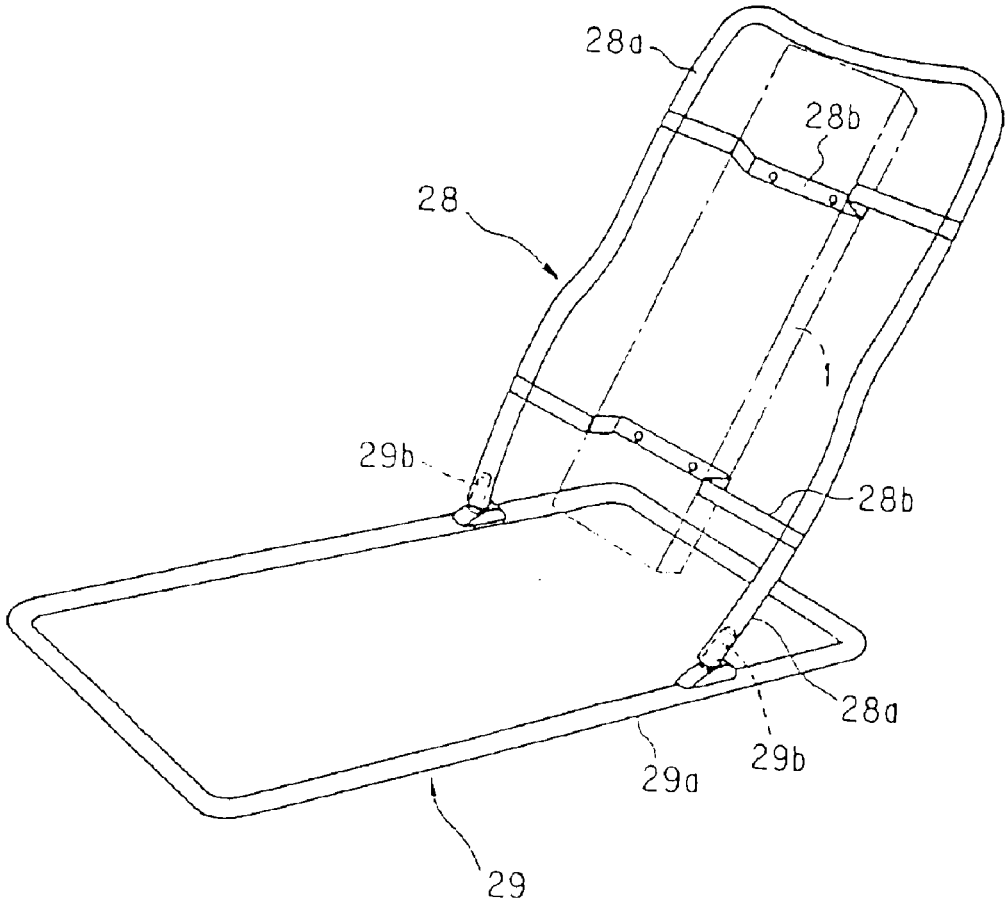
FIG. 11 is a perspective view showing a frame of a legless chair mounted with a motor-driven roller massage instrument.

FIG. 11 shows a frame of a legless chair 27 mounted with the motor-driven roller massage instrument. An outside frame 28*a* of a back portion 28 of the legless chair 27 is formed by bending a steel pipe so as to surround the back portion including no lower side corresponding to the lower side portion of the outside frame 26 of the motor-driven roller massage instrument 25. Similarly to the embodiment shown in FIG. 10, upper and lower lateral rods 28*b*, 28*b* are mounted across the left and right sides of the outside frame 28*a*, and the roller drive device 1 is mounted to a concave portion of each of the upper and lower lateral rods 28*b*. An outside frame 29*a* of a seat portion 29 is formed by bending a steel pipe in a rectangular frame shape, and rotatable connecting projections 29*b* are projecting from the opposite rear ends of the outside frame. The opposite lower ends of the outside frame 28*a* are fitted onto the connecting projections 29*b*, and the back portion 28 and the seat portion 29 are covered with a surface cover through a cushioning material such as a polyurethane foam material.

[Availability of Industrial Utilization]

According to the present invention, the roller chains are mounted in a ring shape round the upper and lower shafts in meshing with the gears mounted to the upper and lower shafts for vertical movement of the massaging ball rollers through the roller chains as described above. For that reason, there is no need for extra structures such as an empty box for receiving a taken-up belt, differently from "a double belt structure for forward and backward traveling" in the prior art. Further, since the roller chains may be moved in surely meshing with the gears mounted to the upper and lower shafts, there is no fear that the roller chains get out of place even though the roller chains are bent to some degree. Thus, there is no need for additional mechanisms for preventing the roller chains from getting out of place, differently from the prior art based on the rotation of an unbending stainless steel belt. Besides, the massaging ball rollers may be guided in accordance with the guide slits to offer various curves without the need for guide rails. As a result, it is possible to provide a simple, compact less-troubled structure.

The roller drive device according to the present invention has a size as high as the upper half of the human body, requires less volume and is lightweight. For that reason, the wider range of its application is expected by incorporating this roller drive device constantly as a unit into the seat of chair, automobile, train and plane or the like. Further, the above roller drive device may be applied to mount to the back of the seat of chair and automobile or the like simply as an individual roller massage instrument.

What is claimed is:

1. A unit-type roller drive device of a size to fit within a chair back rest portion of a chair with protruding massaging ball rollers for engaging the back of a human user's body for motor-driven roller massage actions, said chair back being separate from an associated chair seat, comprising:

a frame having left and right sides extending longitudinally between upper and lower ends and a frame thickness, a base portion, left and right edge portions standing upright from the left and right sides of the base portion to bound a space corresponding with said frame thickness between said upper and lower ends;

a longitudinal guide slit provided in each of the left and right edge portions;

upper and lower shafts each having a gear respectively mounted to the upper and lower ends of the frame;

left and right roller chains respectively mounted on each side of said frame in a ring shape around the upper and lower shafts and meshing with said gears;

a shaft bushing mounted to each roller chain and carrying said massaging ball rollers, the left and right ends of said shaft bushings including guide rollers mounted in said guide slits for guided movement along the slits;

a drive motor mounted to said frame operably connected to said gears to move said roller chains and massaging ball rollers between said upper and lower ends of said frame;

wherein said guide slits and said roller chains are substantially aligned within the thickness of said frame when viewed in longitudinal section, and said gears, roller chains and drive motor are contained within said space corresponding with said frame thickness to provide a compact device that may be incorporated in a chair back with said massaging ball rollers extending beyond said space corresponding with said frame thickness to engage said user's back.

2. A unit-type roller device for motor-driven roller massage actions according to claim 1, wherein each shaft bushing has a plate-shaped base portion fixed to an associated roller chain and a rising piece standing upright from the surface of the base portions, a pivotal massaging ball roller mount piece is mounted to the rising piece for pivotal movement about a horizontal axis, the massaging the ball rollers are mounted to the massaging ball roller mount piece, pins project from the back of said base portion outwardly, and the guide rollers are mounted to said pins and received within guide slits to support and guide said shaft bushings.

3. A unit-type roller drive device for motor-driven roller massage actions according to claim 2, wherein the rising piece has a triangular shape, the massaging ball roller mount piece has a V-shape formed with side pieces that incline in opposite directions and terminate at top ends, said massaging ball rollers are mounted to the respective top ends of the side pieces of said massaging ball roller mount piece, and a stopper projects from the surface of each of said two side pieces.

4. A unit-type roller drive device for motor-driven roller massage actions according to claim 2, wherein sensors to vary the turning direction of the drive motor are provided on one side edge portion of the frame in the vicinity of the upper and lower shafts.

5. A motor-driven roller massage instrument, comprising:

a bucket-shaped base body having a concave portion provided in the center of the base body for installation of the roller drive device and left and right flexible blade piece portions formed on the left and right sides of said concave portion; and belts mounted to the left and right blade piece portions to fasten the user body and also to fasten the other appliance;

wherein the roller drive device according to claim 2, is installed in said concave portion for installation of the roller drive device.

6. A motor-driven roller massage instrument, comprising:

an outside frame surrounding a bucket-shaped portion on all sides; and upper and lower lateral rods mounted across the left and right frame portions of the outside frame and respectively having concave portions;

wherein the roller drive device according to claim 2, is installed in said concave portions.

7. A legless chair mounted with a motor-driven roller massage instrument, comprising:

a back portion rotatably mounted to a seat portion and having an outside frame surrounding the back portion on its upper, left and right sides;

upper and lower lateral rods mounted across the left and right sides of the outside frame and respectively having concave portions;

wherein the roller drive device according to claim 2, is installed in said concave portions.

8. A unit-type roller drive device for motor-driven roller massage actions according to claim 3, wherein sensors to vary the turning direction of the drive motor are provided on one side edge portion of the frame in the vicinity of the upper and lower shafts.

9. A motor-driven roller massage instrument, comprising:

a bucket-shaped base body having a concave portion provided in the center of the base body for installation of the roller drive device and left and right flexible blade piece portions formed on the left and right sides of said concave portion; and belts mounted to the left and right blade piece portions to fasten the user body and also to fasten the other appliance;

wherein the roller drive device according to claim 3, is installed in said concave portion for installation of the roller drive device.

10. A motor-driven roller massage instrument, comprising:

an outside frame surrounding a bucket-shaped portion on all sides; and upper and lower lateral rods mounted across the left and right frame portions of the outside frame and respectively having concave portions;

wherein the roller drive device according to claim 3, is installed in said concave portions.

11. A legless chair mounted with a motor-driven roller massage instrument, comprising:

a back portion rotatably mounted to a seat portion and having an outside frame surrounding the back portion on its upper, left and right sides;

upper and lower lateral rods mounted across the left and right sides of the outside frame and respectively having concave portions;

wherein the roller drive device according to claim 3, is installed in said concave portions.

12. A unit-type roller drive device for motor-driven roller massage actions according to claim 1, wherein sensors to vary the turning direction of the drive motor are provided on one side edge portion of the frame in the vicinity of the upper and lower shafts.

13. A motor-driven roller massage instrument, comprising:

a bucket-shaped base body having a concave portion provided in the center of the base body for installation of the roller drive device and left and right flexible blade piece portions formed on the left and right sides of said concave portion; and belts mounted to the left and right blade piece portions to fasten the user body and also to fasten the other appliance;

wherein the roller drive device according to claim 12, is installed in said concave portion for installation of the roller drive device.

14. A motor-driven roller massage instrument, comprising:

an outside frame surrounding a bucket-shaped portion on all sides; and upper and lower lateral rods mounted across the left and right frame portions of the outside frame and respectively having concave portions;

wherein the roller drive device according to claim 12, is installed in said concave portions.

15. A legless chair mounted with a motor-driven roller massage instrument, comprising:

a back portion rotatably mounted to a seat portion and having an outside frame surrounding the back portion on its upper, left and right sides;

upper and lower lateral rods mounted across the left and right sides of the outside frame and respectively having concave portions;

wherein the roller drive device according to claim 12, is installed in said concave portions.

16. A motor-driven roller massage instrument, comprising:

a bucket-shaped base body having a concave portion provided in the center of the base body for installation of the roller drive device and left and right flexible blade piece portions formed on the left and right sides of said concave portion; and belts mounted to the left and right blade piece portions to fasten the user body and also to fasten the other appliance;

wherein the roller drive device according to claim 1, is installed in said concave portion for installation of the roller drive device.

17. A motor-driven roller massage instrument, comprising:

an outside frame surrounding a bucket-shaped portion on all sides; and upper and lower lateral rods mounted across the left and right frame portions of the outside frame and respectively having concave portions;

wherein the roller drive device according to claim 1, is installed in said concave portions.

18. A legless chair mounted with a motor-driven roller massage instrument, comprising:

a back portion rotatably mounted to a seat portion and having an outside frame surrounding the back portion on its upper, left and right sides;

upper and lower lateral rods mounted across the left and right sides of the outside frame and respectively having concave portions;

wherein the roller drive device according to claim 1, is installed in said concave portions.

* * * * *

UNITED STATES PATENT AND TRADEMARK OFFICE

CERTIFICATE OF CORRECTION

PATENT NO. : 6,840,914 B1
DATED : January 11, 2005
INVENTOR(S) : Shigeo Takamura It is certified that error appears in the above-identified patent and that said Letters Patent is hereby corrected as shown below:

Column 6,
Line 36, delete "the back of".

Signed and Sealed this

Seventh Day of June, 2005

JON W. DUDAS
*Director of the United States Patent and Trademark Office*